US007039350B2

(12) United States Patent
Frodl et al.

(10) Patent No.: US 7,039,350 B2
(45) Date of Patent: May 2, 2006

(54) TRANSFER PRINTING STATION FOR AN ELECTROGRAPHIC PRINTER OR COPIER

(75) Inventors: Herbert Frodl, Poing (DE); Christian Kürmeier, Erding (DE)

(73) Assignee: Oce Printing Systems GmbH, Poing (DE)

( * ) Notice: Subject to any disclaimer, the term of this patent is extended or adjusted under 35 U.S.C. 154(b) by 128 days.

(21) Appl. No.: 10/471,676

(22) PCT Filed: Mar. 13, 2002

(86) PCT No.: PCT/EP02/02810

§ 371 (c)(1),
(2), (4) Date: Nov. 24, 2003

(87) PCT Pub. No.: WO02/077719

PCT Pub. Date: Oct. 3, 2002

(65) Prior Publication Data

US 2004/0091293 A1 May 13, 2004

(30) Foreign Application Priority Data

Mar. 22, 2001 (DE) ..... 101 13 999

(51) Int. Cl.
*G03G 21/18* (2006.01)

(52) U.S. Cl. ..... 399/313; 399/121

(58) Field of Classification Search ..... 399/297, 399/307, 310, 313, 314, 315, 316, 381, 384, 399/121
See application file for complete search history.

(56) References Cited

U.S. PATENT DOCUMENTS

| | | | | |
|---|---|---|---|---|
| 4,050,803 | A * | 9/1977 | McCarroll | 399/122 |
| 4,998,143 | A | 3/1991 | Kumasaka et al. | |
| 5,159,393 | A * | 10/1992 | Hiroshima et al. | 399/313 |
| 5,548,390 | A | 8/1996 | Sugisaki et al. | |
| 5,572,305 | A * | 11/1996 | Hayashi et al. | 399/121 |
| 5,659,863 | A * | 8/1997 | Kawabata et al. | 399/303 |
| 5,909,605 | A | 6/1999 | Nishizawa et al. | |
| 6,072,977 | A | 6/2000 | Murakami | |
| 6,097,913 | A | 8/2000 | Bertram et al. | |

(Continued)

FOREIGN PATENT DOCUMENTS

| | | |
|---|---|---|
| EP | 0 154 695 | 12/1984 |
| EP | 0 592 197 | 4/1994 |
| EP | 0 672 966 | 9/1995 |

(Continued)

*Primary Examiner*—Hoan Tran
(74) *Attorney, Agent, or Firm*—Schiff Hardin LLP

(57) ABSTRACT

The invention relates to a transfer printing station for an electrographic printer or copier wherein the transfer is carried out by means of a transfer roller (5) that simultaneously forces a web of paper (8) against a photoconductor drum (1) in such a manner that no defective spots (data loss) or bright spots in scanning patterns, indefinite scanning patterns and horizontal stripes in scanning patterns occur on the paper web (8). This is especially important for the subsequent printers of a system of printers that have to print onto a paper that is stressed by the fixing station of the preceding printer. The transfer roller (5) is disposed in a swiveled support unit (4) that comprises, in addition to the guide of the paper web (8), transfer jaws (11) along the photoconductor drum (1). The inventive transfer printing station is especially suitable for use in printing systems with a plurality of printers or copiers.

20 Claims, 2 Drawing Sheets

U.S. PATENT DOCUMENTS

Figure 1:
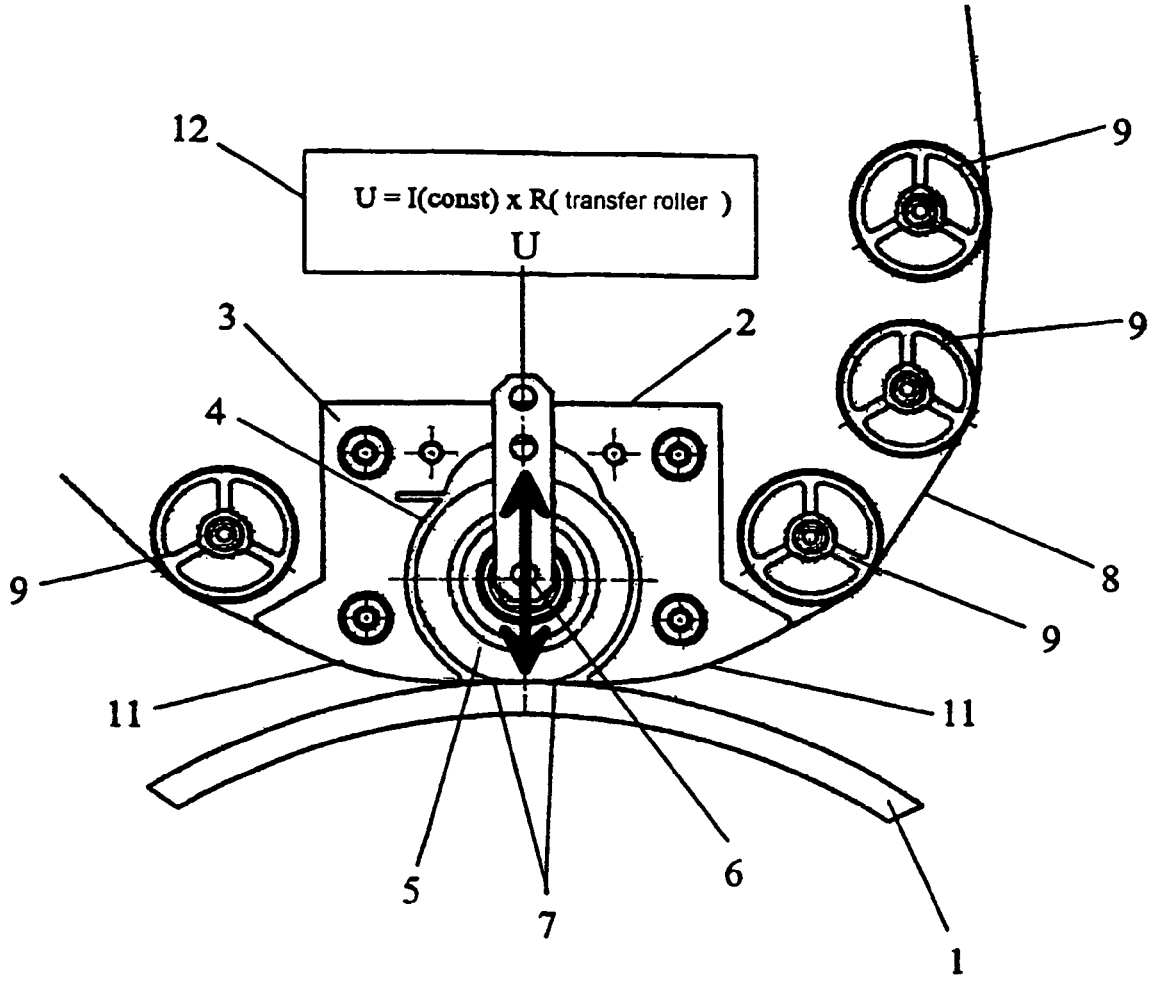

| | | | | |
|---|---|---|---|---|
| 6,111,594 | A | 8/2000 | Jeong | |
| 6,208,826 | B1 * | 3/2001 | Yoshinaga et al. | 399/318 |
| 6,487,388 | B1 * | 11/2002 | Theodoulou et al. | 399/307 |
| 6,625,407 | B1 * | 9/2003 | Shifley et al. | 399/110 |

FOREIGN PATENT DOCUMENTS

| | | |
|---|---|---|
| EP | 0 866 379 | 9/1998 |
| EP | 1 079 283 | 2/2001 |
| WO | WO 99/24876 | 5/1999 |

* cited by examiner

TRANSFER PRINTING STATION FOR AN ELECTROGRAPHIC PRINTER OR COPIER

Electrophotographic printer or copier devices are known from U.S. Pat. No. 6,072,977 or WO 99/14876, for example. They comprise, for example, a photoconductor drum as an intermediate carrier on which, for example, a reproduction of the image to be printed on a recording medium (for example, a paper web) via transfer printing is generated by means of a laser or an LED character generator. Subsequently, the intermediate carrier is moved past a developer station in which the charge image is inked on the intermediate carrier with toner and a toner image is thus generated. In a transfer printing station, the toner image is then transferred from the intermediate carrier to the recording medium and after that thermally set in a fixing station. The intermediate carrier is unloaded and is then available for a new print event or copy event.

The toner image should, if at all possible, be transfer printed from the intermediate carrier onto the recording medium without error. In the transfer printing methods used today in continuous printers in the speed range of up to 1.5 m/s and more, print image errors consist primarily in the occurrence of flaws (data loss)—what are called voids or, respectively, brightenings in moiré patterns, in indistinct moiré patterns, and cross-stripes in moiré patterns on the recording medium. Particularly critical is the second printer of a twin system, as it is known, for example, from EP 0154 695 B1 (or, respectively, the third printer of a triple system, etc.), that must print on a paper stressed (rippled, shrunken, exhibiting moisture loss) by the fixing station of the preceding printer.

Prior art in continuous printers today is transfer printing with a transfer corotron; this is known, for example, from WO 99/24876. Here, the recording medium is directed without additional contact pressure in the actual transfer printing area to the intermediate carrier, and the print image is transfer printed with the aid of the transfer corotron from the intermediate carrier onto the recording medium. The force generated by the electrical field between transfer corotron and intermediate carrier is often insufficient to lay a rippled recording medium completely flat on the intermediate carrier. The described print image errors, such as imperfections and moiré blurrings, thereby ensue. Furthermore, the recording medium can effect uncontrolled relative motions on the intermediate carrier, due to the small electrostatic adhesion. This shows itself via cross-stripes in moiré patterns.

It is further known from WO 99/24876 to combine additional transfer printing aids (transfer blade, pressure roller, transfer printing jaws, etc.) with a transfer corotron. However, the problems described above could not thereby be completely stopped, since the mechanical contact pressure of the recording medium on the intermediate carrier together with a transfer corotron does not ensue in the actual transfer printing area.

In single page printers, it is namely known (for example, U.S. Pat. No. 6,072,977) to use as a transfer printing means a transfer roller that presses the recording medium onto the intermediate carrier in the transfer printing area; an application in continuous printing was eliminated until now because the high printing speeds and the requirement of swiveling and pivoting the paper web at the photoconductor.

Further known from U.S. Pat. No. 6,072,977 is a photoelectric image generation device that comprises a transfer roller which, under pressure, contacts the surface of a recording medium and transfers the toner image onto it. The transfer roller is pressed against the intermediate carrier with the aid of springs, such that the recording medium lies flat on the intermediate carrier from both sides of the recording medium. The transfer roller is positioned stationary and is not pivoted back and forth.

EP-0 592 197 A2 specified a copier device. A transfer roller to transfer the toner image onto a recording medium is positioned such that it can be pivoted away from the intermediate carrier and pivoted back to it again. The transfer roller is pressed against the recording medium in order to ensure the transfer of the toner image.

Furthermore, reference is made to U.S. Pat. No. 5,909,605 and U.S. Pat. No. 6,111,594 as prior art.

The object of the invention is to develop a transfer printing station of an electrographic printer device or copier device, such that an error-free transfer printing also ensues in high-speed printing. This should in particular also be ensured in the use of twin or, respectively, triplex systems. For this, is must be achieved that the recording medium lies securely in the transfer printing area on the intermediate carrier, no irregularities ensue in the relative speed between recording medium and intermediate carrier, and no print image errors ensue on the recording medium.

The problem specified above is solved according to the features of the additionally arrayed main claims.

With the inventive solution, among other things the following advantages arise:

- The recording medium is uniformly pressed with the transfer roller onto the intermediate carrier over the entire width.
- Electric field lines and pressing force on the recording medium work at the same location—in the transfer printing area—and in the same direction.
- Due to the suitable selected pressing force of the transfer roller, irregularities in the relative speed are prevented between recording medium and intermediate carrier, and the print image errors specified above are effectively prevented.

Developments of the invention ensue from the dependent claims.

To improve the print quality, what is advantageous is the use of two transfer printing jaws that readily press on the intermediate carrier at some distance before and after the transfer printing area. The enlargement of the belt wrap thereby achieved prevents uncoordinated transfer printing due to free spark gaps before and after the actual transfer printing location, and thus generates a sharper image on the recording medium.

To use the transfer roller in continuous printing, it is advantageous that it can be pivoted away from the intermediate carrier. In addition, the transfer roller can be elastically arranged in a channel in a carrier unit that can be pivoted away from the intermediate carrier.

It is particularly advantageous when the function of the cleaning via suction cleaning of the waste particles, for example toner/paper dust, is integrated into the carrier unit. For this, a suction cleaning channel is provided in expansion of the channel for the transfer roller. Given this solution, the suction cleaning of the waste particles ensues directly in the area of the transfer roller.

It is advantageous when the transfer roller consists of a conductive core (for example, steel) that is coated with conductive, elastic (gummy) material. The material can be selected such that recording mediums of different widths can be printed without requiring that the transfer roller be changed.

In the carrier unit, the transfer roller is thereby arranged such that it presses on the recording medium with specific force and specific nip on the intermediate carrier.

In order to enable a greater lifespan of the transfer roller, it is practical that the aging-dependent resistance of the transfer roller at the beginning lies in a defined range.

For a consistent transfer printing quality over a longer period, it is advantageous to use a current-regulated power supply. The voltage thereby adjusts corresponding to the resistances of transfer roller and recording medium. Moreover, a voltage limitation in the power supply is advisable because of the danger of arcing over between the intermediate carrier and transfer roller.

Since the transfer roller presses the recording medium onto the intermediate carrier in the transfer printing area, and so that the results of a stressed recording medium (for example, due to an earlier thermosetting) are removed, the transfer printing station in printing devices can be used with a plurality of printing devices (twin system, triple system). At least the printing devices following the first printing device then use a pressure roller that presses the recording medium onto the intermediate carrier such that, in spite of the stressed (for example, rippled) recording medium, no print image errors ensue. In a convenient manner, the inventive transfer roller, together with the transfer printing station, is used as a pressure roller.

The invention is further explained using the figures. Thereby shown are

Figure 2:
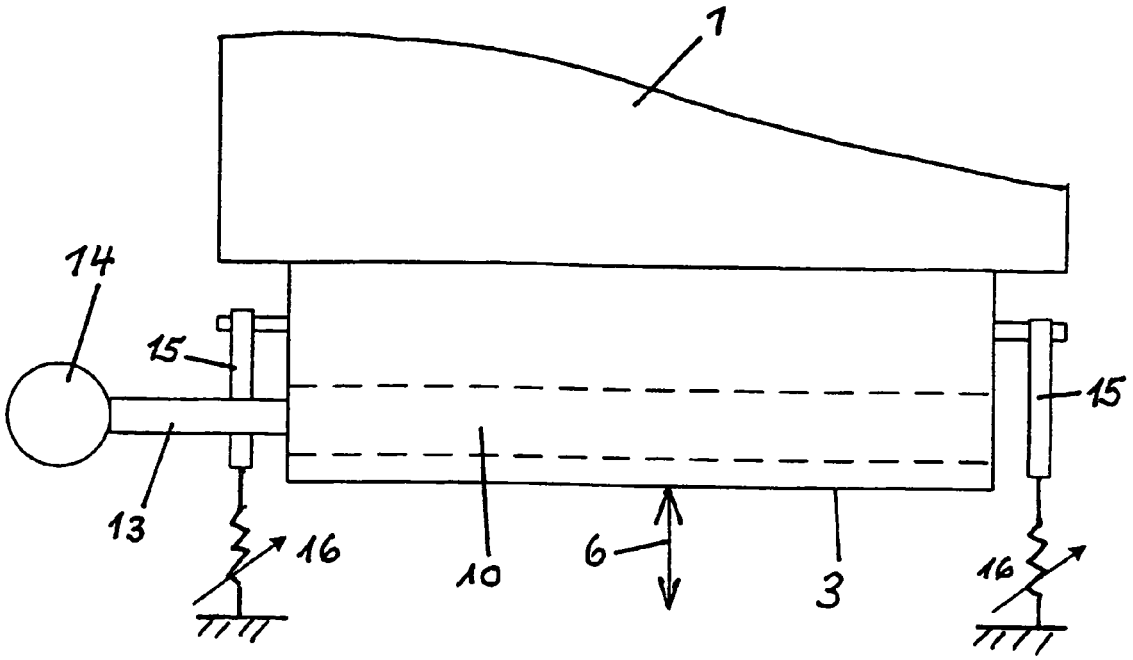
Figure 3:
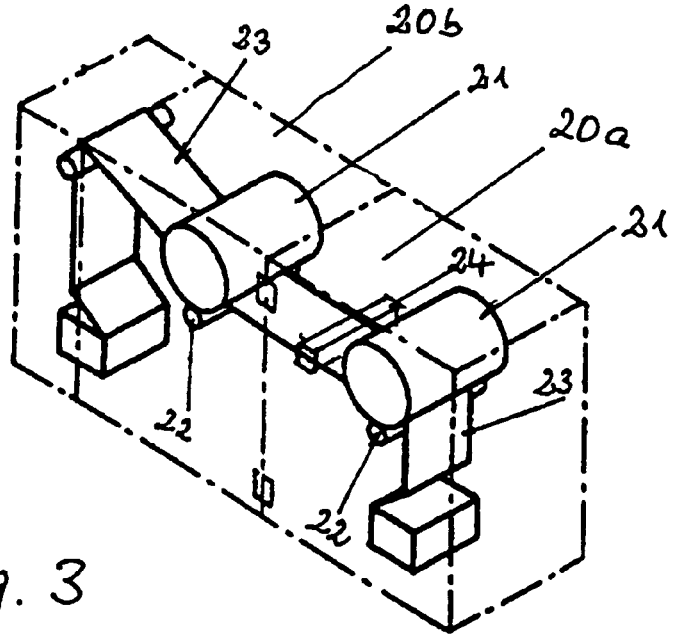

FIG. 1 a cutaway from a printer or copier, namely the part that represents the transfer printing station;

FIG. 2 the transfer printing station with a cutaway of the intermediate carrier, whereby the position of the suction cleaning channel is shown in particular;

FIG. 3 a printing device with two printing devices.

First explained is FIG. 1, which shows the assembly of the transfer printing station from the side.

Arranged adjacent to an intermediate carrier 1 (for example, a photoconductor drum) is a transfer printing station 2. This comprises a carrier unit 3 in which a transfer roller 5 is rotatably arranged in a channel 4. The carrier unit 3 can be swiveled or pivoted on the intermediate carrier 1 in the direction of the arrow 6. In the event of swiveling, the transfer roller 5 is uniformly pressed on the intermediate carrier 1 with specific force (for example 50–100 N) over its entire width in the direction of the arrow 6. A contact surface 7 (nip) of, for example, 3–5 mm is thereby formed. In this manner, irregularities (in the relative speed between the recording medium 8 (for example, a paper web) and the intermediate carrier 1) and print image errors are prevented. The recording medium 8 is in addition guided to the transfer printing station 3 with the aid of guide rollers 9 and guided away from these.

The channel 4 of the carrier unit 3 is (FIG. 2), opposite the intermediate carrier 1, expanded to a suction cleaning channel 10, via which waste particles such as, for example, toner particles or paper dust can be suction cleaned from the transfer roller 5. The suction cleaning channel 10 extends over the width of the transfer roller 5, and the transfer roller 5 can thus be cleaned of waste particles over its entire length. The suction cleaning channel can flow into a suction tube 13 that is connected with a pneumatic suction device 14 (schematically shown).

In order to achieve an optimal guiding of the recording medium 8 through the transfer printing station, the carrier unit 3 is furthermore fashioned such that transfer printing jaws 11 are provided at the sides facing the intermediate carrier 1 in front of and/or behind the transfer printing area 7, with which an enlargement of the belt wrap of the recording medium 8 with regards to the intermediate carrier 1 is achieved, whereby an uncoordinated transfer printing due to free spark gaps before and/or after the transfer printing area 7 are [sic] prevented, and with which a sharper image is generated on the recording medium 8.

The transfer roller 5 comprises a conductive core, for example steel, that is coated with a conductive gummy material with a Shore-Härte of, for example, 40. A possible assembly can be learned from U.S. Pat. No. 6,072,977. The resistance of the transfer roller 5 is thereby selected between 10 MΩ–40 MΩ and therewith lies in a range that enables a longer lifespan of the transfer roller.

In order to achieve an invariable transfer printing quality over a longer period of time, a power-regulated power supply 12 is provided that generates a transfer voltage U for the transfer roller 5 that changed according to the formula $$U = I(\text{const}) \times R(\text{transfer roller})$$

dependent on the resistance of the transfer roller. The determination of the resistance of the transfer roller can thus ensue as it is specified in U.S. Pat. No. 6,111,594. Furthermore, a voltage limitation in the power supply is provided to prevent an arc-over between the intermediate carrier 1 and the transfer roller 5.

From FIG. 2, a storage 15 for the transfer roller 5 is schematically shown next to the position of the suction cleaning channel 10. Furthermore, a spring device 16 is shown that can apply an adjustable elastic force (indicated by an arrow) on the storage 15. As is specified above, the transfer roller presses the recording medium (not shown) onto the intermediate carrier 1.

A print device with two printers 20*a,b* (twin system) arises from FIG. 3. Such a print device is known from EP 0 154 695 B1, for example. From the printers, merely the respective intermediate carrier 21, a pressure roller 22 (for example the transfer roller within the transfer printing station), and the recording medium 23 is [sic] shown. The recording medium 23 runs through the first printer 20*a*, in which a toner image is transferred from the intermediate carrier to the recording medium. Subsequently, the toner image is fixed on the recording medium in a fixing station 24 that, for example, effects a thermosetting. In this event, the recording medium is stressed- rippled, for example. The recording medium is subsequently supplied to the next printer 20*b* and there further printed upon. No print image errors occur thereby, in spite of the recording medium being stressed by the fixing, since in the transfer printing station a pressure roller presses the recording medium 23 onto the intermediate carrier 21 with appropriate pressing force. Suited in particular for this is the transfer roller of the transfer printing station specified above that, together with the transfer printing station, can be used at least in the printers following the first printer.

REFERENCE LIST

1 intermediate carrier
2 transfer printing station
3 carrier unit
4 channel
5 transfer roller
6 arrow
7 contact surface (nip)
8 recording medium
9 guiding roller

10 suction cleaning channel
11 transfer printing jaws
12 power supply
13 suction tube
14 suction device
15 storage
16 spring device
20 printers
21 intermediate carrier
22 transfer roller
23 recording medium
24 fixing station

The invention claimed is:

1. A transfer printing station for an electrographic printer or copier, comprising:

a transfer roller to which has been applied a transfer voltage to transfer a toner image generated on an electrographic intermediate carrier onto a recording medium in a transfer printing area of the transfer printing station;

the transfer roller in the transfer printing area pressing the recording medium over its entire width onto the intermediate carrier such that substantially no print image errors occur, even given a rippled recording medium;

the transfer roller being arranged in a carrier unit lying adjacent to the intermediate carrier that can be pivoted from the intermediate carrier; and the transfer roller being elastically mounted in a channel of the carrier unit in a direction of the intermediate carrier and such that it can be rotated.

2. The transfer printing station according to claim 1 wherein a pressing force of the transfer roller is selected such that a contact surface exists with a contact line of 3–5 mm along a perimeter between the transfer roller and the intermediate carrier.

3. The transfer printing station according to claim 2 wherein the pressing force lies in a range of 50–100 N.

4. The transfer printing station according to claim 1 wherein arranged at at least one of in front of and behind the transfer roller is a transfer printing jaw that presses the recording medium onto the intermediate carrier at at least one of before and after the transfer printing area.

5. The transfer printing station according to claim 1 wherein the carrier unit facing the intermediate carrier comprises at least one transfer printing jaw that in the transfer printing operation presses the recording medium onto the intermediate carrier in the transfer printing area.

6. The transfer printing station according to claim 1 wherein the channel in the carrier unit is extended to a suction cleaning channel that serves to suction clean undesired particles from the transfer roller.

7. The transfer printing station according to claim 1 wherein the transfer roller comprises a conductive fixed core that is covered by a conductive elastic material.

8. The transfer printing station according to claim 7 wherein the fixed core of the transfer roller comprises steel that is enclosed by a conductive material.

9. The transfer printing station according to claim 7 wherein the elastic material is selected such that recording media of different widths are used without changing the transfer roller.

10. The transfer printing station according to claim 1 wherein the transfer voltage is adjusted dependent on resistances of the transfer roller and the recording medium.

11. The transfer printing station according to claim 10 wherein a level of the transfer voltage is limited.

12. The transfer printing station according to claim 1 wherein the transfer printing station is part of a print device of a continuous printer.

13. The transfer printing station according to claim 1 wherein the transfer printing station is respectively used in print devices of a plurality of printers or copiers.

14. An electrographic printer or copier device, comprising:

at least first and second electrographic print engines which can record an image on a recording medium, the second print engine following the first print engine;

at least the second print engine comprising a transfer printing station having a transfer roller to which has been applied a transfer voltage to transfer a toner image generated on an electrographic intermediate carrier onto the recording medium in a transfer printing area of the transfer printing station; and the transfer roller in the transfer printing area elastically pressing the recording medium onto the intermediate carrier such that substantially no print image errors occur, even given a rippled recording medium.

15. The device of claim 14 wherein the transfer roller is arranged in a carrier unit lying adjacent to the intermediate carrier, and the transport transfer roller being received in a channel of the carrier unit.

16. A method for transfer printing from a toner image applied on an electrophotographic intermediate carrier to a recording medium, comprising the steps of:

providing a transfer printing station having a transfer roller;

arranging the transfer roller in a carrier unit lying adjacent to the intermediate carrier so that it can be pivoted from the intermediate carrier;

elastically mounting the transfer roller in a channel of the carrier unit in a direction of the intermediate carrier and permitting it to rotate; and generating the toner image on the electrophotographic intermediate carrier, applying a transfer voltage to the transfer roller, and transferring the toner image generated on the electrophotographic intermediate carrier onto the recording medium in a transfer printing area of the transfer printing station, the transfer roller pressing the recording medium over its entire width onto the intermediate carrier such that substantially no print image errors occur, even given a rippled recording medium.

17. A print device, comprising:

at least first and second print engines that sequentially print on a same recording medium;

at least the first print engine printing on the recording medium comprising a thermofusing station; and at least the second print engine subsequent to the first print engine comprising in a transfer printing area a pressing roller that elastically presses the recording medium onto an intermediate carrier such that substantially no print image errors occur even when the recording medium is stressed by thermofusing of the preceding first print engine.

18. The device according to claim 17 wherein the pressing roller is arranged in a carrier unit lying adjacent to the intermediate carrier that can be pivoted from the intermediate carrier, and wherein the pressing roller is elastically mounted in a channel of the carrier unit in a direction of the intermediate carrier and can be rotated.

19. A transfer printing station for an electrographic printer or copier, comprising:

a transfer roller to which has been applied a transfer voltage to transfer a toner image generated on an electrographic intermediate carrier onto a recording medium in a transfer printing area of the transfer printing station;

the transfer roller in the transfer printing area pressing the recording medium onto the intermediate carrier such that substantially no print image errors occur, even given a rippled recording medium;

the transfer roller being arranged in a carrier unit lying adjacent to the intermediate carrier; and the transfer roller being mounted in a channel of the carrier unit.

20. A method for transfer printing from a toner image applied on an intermediate carrier to a recording medium, comprising the steps of:

providing a transfer printing station having a transfer roller;

arranging the transfer roller in a carrier unit lying adjacent to the intermediate carrier so that it can be pivoted from the intermediate carrier;

storing the transfer roller in a channel of the carrier unit; and generating a toner image on an electrographic intermediate carrier, applying a transfer voltage to the transfer roller, and transferring a toner image generated on the electrographic intermediate carrier onto the recording medium in a transfer printing area of the transfer printing station, and during said transfer, with the transfer roller pressing the recording medium onto the intermediate carrier such that substantially no print image errors occur, even given a rippled recording medium.

* * * * *